US005729260A

United States Patent [19]

Mitani et al.

[11] Patent Number: 5,729,260

[45] Date of Patent: Mar. 17, 1998

[54] INK JET PRINTER WITH HIGH POWER, SHORT DURATION PULSE

[75] Inventors: Masao Mitani; Kenji Yamada; Kazuo Shimizu; Osamu Machida, all of Katsuta, Japan

[73] Assignee: Hitachi Koki Co., Ltd., Tokyo, Japan

[21] Appl. No.: 331,742

[22] Filed: Oct. 31, 1994

[30] Foreign Application Priority Data

Oct. 29, 1993 [JP] Japan ..... 5-272451

[51] Int. Cl.[6] ..... B41J 29/38; B41J 2/05

[52] U.S. Cl. ..... 347/57; 347/10

[58] Field of Search ..... 347/9, 14, 57, 347/61, 56, 58, 92, 204, 62, 64

[56] References Cited

U.S. PATENT DOCUMENTS

| | | | |
|---|---|---|---|
| 4,313,124 | 1/1982 | Hara | 347/9 |
| 4,345,262 | 8/1982 | Shirato et al. | 347/10 |
| 4,517,444 | 5/1985 | Kawahito et al. | 347/204 |
| 4,646,105 | 2/1987 | Matsumoto et al. | 347/57 |
| 5,206,659 | 4/1993 | Sakurai et al. | 347/62 |
| 5,214,450 | 5/1993 | Shimoda | 347/57 |
| 5,444,475 | 8/1995 | Mitani | 347/204 |
| 5,479,196 | 12/1995 | Inada | 347/92 |

FOREIGN PATENT DOCUMENTS

| | | | |
|---|---|---|---|
| 3012720A1 | 10/1980 | Germany . | |
| 3018852A1 | 11/1980 | Germany | 347/57 |
| 3224061A1 | 1/1983 | Germany . | |
| 3618533A1 | 12/1986 | Germany . | |
| 4141203A1 | 6/1992 | Germany | 347/57 |
| 4317944A1 | 8/1996 | Germany | 347/304 |
| 57-61582 | 4/1982 | Japan | 347/204 |

OTHER PUBLICATIONS

Norbert Elsner. "*Convective Heat Transfer when Changing the Aggregate State*" 1980, pp. 515–525.

*Primary Examiner*—Benjamin R. Fuller
*Assistant Examiner*—L. Anderson
*Attorney, Agent, or Firm*—Whitham, Curtis, Whitham & McGinn

[57] ABSTRACT

An ink ejection printer includes an ink channel filled with ink, a nozzle which brings the ink channel into fluid connection with an outside atmosphere, and a thermal resistor formed in the ink channel near the nozzle. The thermal resistor received a pulse of voltage, whereupon the thermal resistor rapidly heats so that a portion of the ink in the ink channel is rapidly vaporized by subcool boiling, which is caused by swing nucleation, to produce a bubble, expansion of the bubble ejecting an ink droplet from the nozzle. With the thermal resistor, boiling starts within 2 μS after application of the pulse of voltage begins. The pulse of voltage is applied to the thermal resistor for a duration of 3 μS or less. The bubble generated by application of the pulse of voltage to the thermal resistor disappears without the thermal resistor generating secondary bubbles. The bubble generated by application of the pulse of voltage of the thermal resistor disappears within 11 μS after application of the pulse. Energy required to generate the bubble is 4 μJ/50×50 μm$^2$ or less.

18 Claims, 3 Drawing Sheets

INK JET PRINTER WITH HIGH POWER, SHORT DURATION PULSE

BACKGROUND OF THE INVENTION

1. Field of the Invention

The present invention relates to an ink jet printer that uses heat energy for ejecting ink droplets toward a recording medium.

2. Description of the Related Art

Japanese Patent Application Kokai Nos. SHO-48-9622, SHO-54-51837, SHO-54-59936, SHO-54-161935 describes a type of ink jet printer with channels filled with ink and nozzles, each in fluid communication with an ink channel. A pulse of heat is applied to the ink, which rapidly vaporizes as a result. The expansion of the resultant vapor bubble ejects a droplet of ink from the corresponding nozzle.

The most effective method of producing the heat pulse is with a thin film thermal resistor provided in the ink channel. Practical examples of thin film thermal resistors are described at page 58 of the "Nikkei Mechanical", published Dec. 28, 1992 and th "Hewlett-Packard Journal" published August 1988. These thermal resistors commonly include a thin film resistor with a great thermal endurance, a metal thin film conductor, and a two-layer protective covering over the thin film resistor and the metal thin film conductor. The thin film forming the thin film resistors is about 0.1μ thick. The two-layer structure of the protective covering is about 3 to 4μ thick in total. The first layer of the protective covering is in contact with the thin film resistor and the metal thin film conductor and is for protection against oxidation and electrochemical corrosion. The second protective layer is provided for protecting the first protective layer against damage from cavitation.

Thermal resistors constructed as described above are used to pulse heat and rapidly vaporize the portion of the ink adjacent to the thermal resistor. Ink droplets are ejected by expansion of the resultant bubbles. Printers must be able to rapidly repeat the ejection process which includes not only expansion of bubbles, but also the contraction and final disappearance of bubbles. Four conditions are required to produce a printer that can eject ink droplets stably and rapidly in succession at a high frequency.

The first condition relates to the generation of bubbles. Japanese Patent Application Kokai Nos. SHO-55-27282 and SHO-56-27354 teach that in order to increase ejection efficiency, response, and frequency characteristics, the temperature at the surface of the thermal resistor must be rapidly increased to thereby invoke film boiling in the ink in contact with the thermal resistor, and the processes A through E shown in FIG. 1, which show the boiling characteristic curve of water, should be kept as short as possible. However, there are two points in the technical explanation and understanding in these publications which need correction.

The first point to be corrected in that the boiling characteristic curve shown in FIG. 1 represents a set stable state whereas ejection of ink droplets occurs in an unstable state. In the boiling characteristic curve shown in FIG. 1, the temperature at the heater surface that contacts the water is stable or rises and lowers slowly. Boiling which occurs from application of a pulse of heat is unsteady boiling. In fact, in subsequent research (see page 7 of Collection of Presentations from the 22nd Japan Thermal Transmission Symposium 1985-5), the inventors of the above-listed applications disclose that tests bubbles were generated at 263° C. This temperature matches the superheating limit of 270° C. predicted by the theory of spontaneous nucleation. That is, bubbles are generated by unstable boiling, which is a very different phenomenon from the phenomenon of stable boiling represented in FIG. 1.

The second point to be corrected is the inappropriate use of the term film boiling. Film boiling assumes that conditions continue for a certain length of time. However, an extremely short pulse of heat rapidly generates a single bubble that vanishes in an extremely short period of time. In later research (see page 7 of the Collection of Presentations from the 22nd Japan Thermal Transmission Symposium 1985-5, on page 247 of the Collection of Presentations from the Journal for the 23rd Japan Thermal Transmission Symposium 1986-5, and on page 253 of the Collection of Presentations from the Journal for the 25th Japan Thermal Transmission Symposium 1988-6), the inventors of the above-listed applications changed their opinions to say that a small bubble is formed from spontaneous nucleation (also referred to as nonhomogeneous nucleation) at a portion of the heater surface and afterward rapidly expands to the entire surface of the heater.

Therefore, it is technically incorrect to say that in order to increase ejection efficiency, response, and frequency characteristics, the temperature at the surface of the thermal resistor must be rapidly increased to thereby invoke film boiling in the ink in contact with the thermal resistor, and the processes A through E shown in FIG. 1, which shows the boiling characteristic curve of water, should be kept as short as possible. Taking the two points into consideration, a more accurate statement would be that the ink in contact with the surface of the heater should be brought into a film boiling condition in as short a time as possible.

Japanese Patent Application Kokai No. HEI-03-266646 describes a thermal ink jet print heat which uses a boiling phenomenon appearing when ink is heated under conditions different from those in the above-described research. The surface of the heater is raised at a speed of $10^6$ to $10^{9}$° C./S and the heat flux from the heater surface to the ink is set at $10^7$ to $10^8$ W/m$^2$. The temperature at the heater surface and the ink adjacent to the heater surface is rapidly heated to the temperature at which homogeneous nucleation occurs. Ink is ejected by a homogeneous nucleated bubble.

The type of boiling that is ordinarily observed occurs by vapor nucleation. For example, vapor nucleation occurs at defects in the solid surface in contact with water when the temperature of the water reaches about 100° C.

Spontaneous nucleation occurs when no defects are present in the solid surface in contact with the liquid to be boiled, that is, when the solid surface is perfectly uniform. Boiling activated by spontaneous nucleation occurs simultaneously over the entire boundary between the solid surface and the liquid. When the liquid to be boiled is water, boiling will start only when the temperature at the solid surface reaches about 270° C. Spontaneous nucleation is also referred to as non-homogeneous nucleation because thus activated boiling occurs where solid and liquid coexist.

Homogeneous nucleation occurs only in superheated homogeneous liquids in contact with a uniform solid surface, as described above for spontaneous nucleation, that is rapidly heated. Refer to V. P. Skripove, Metastable Liquids, John Wiley, New York 1974. The temperature at which homogeneous nucleation is assumed to occur in water is 312.5° C. However, it is technically difficult to produce a heater which an generate the extremely rapid increase in temperature necessary for homogeneous nucleation to occur. In fact, there has been no confirmation of an actual heater with this capability.

Homogeneous nucleation is termed homogeneous, despite the presence of a solid surface, because homogeneous nucleation can be observed only in homogeneous liquids. Boiling begins in water adjacent to the boundary between the liquid and the solid surface when critical values for both the speed at which the solid surface rises and the heat flux that is transmitted to the liquid from the solid surface are exceeded and when the temperature at the solid surface and the water adjacent to the solid surface exceeds 312.5° C.

Recently, Iida et al experimentally verified this phenomenon as discussed on page 334 of Collection of Presentations from the 27th Japan Thermal Transmission Symposium 1990-5. The invention described in Japanese Patent Application Kokai No. HEI-03-266646 is based on the results of these experiments, in which the thermal resistor and the electrode are formed from the same material. However, the width of the electrode is at least five times and up to ten times the width of the thermal resister. This makes manufacturing an inexpensive large-scale line head difficult, although a head with a low density of 30 dpi could possibly be produced. That is, using this thermal resistor in a high density multi-nozzle type ink jet print head would be impossible without adding some further contrivance.

The second condition relates to the speed at which the thermal resistor is heated. Japanese Patent Application Kokai No. SHO-55-161664 teaches that the average speed at which temperature of the thermal resistor increases (hereinafter referred to as "average speed of temperature increase") should be $1\times10^{6}$° C./sec or more, preferably $3\times10^{6}$° C./sec or more, and optimally $1\times10^{7}$° C./sec or more. The liquid described in the publication is ink made mainly from ethanol. Recently, Iida et al performed precise experiments using pure ethanol. The average speed of temperature increase and the number of bubbles generated during these experiments are described in detail on page 712 of Collection of Presentations from the 28th Japan Thermal Transmission Symposium 1991-5. Although some discrepancies in the data can be accounted for by differences between pure ethanol and ink made mostly from ethanol, the most noteworthy result is that bubbles were generated at a density, which most closely governs ejection of ink, that was two orders of magnitude greater in ethanol than in water at the same average speed of temperature increases. That is, in order to generate the same number of bubbles in the same density, water must be heated at an average speed of temperature increase that is ten times faster than the average speed of temperature increase required for ethanol.

Therefore, a great technological leap is required to apply the invention described in Japanese Patent Application Kokai No. SHO-55-161664 to water based ink. An extremely fast average speed of temperature increase of about $1\times10^{8}$° C./sec or more is required to stably eject water based ink. Asai et al performed experiments using water based ink as described on page 253 of the Collection of Presentations from the 25th Japan Thermal Transmission Symposium Collection of Presentations 1988-6. The speed of ink ejection was unstable at the extremely fast average speed of temperature increase of about $0.9\times10^{8}$° C./sec. (270° C./3 μsec). On the other hand, the value described in Japanese Patent Application Kokai No. HEI-03-266646, that is, $10^{6}$ to $10^{9}$° C./sec or greater, does not clearly show the value or range of the thermal speed.

The third condition relates to the time between when the heat pulse starts and when the liquid starts to boil (hereinafter referred to as "the time to boiling start"). Asai et al discloses use of a naked heater without protective layers (page 7 of the Collection of Presentations from the 22nd Japan Thermal Transmission Symposium 1985-5). Although the lack of protective layers improves rate of heat transmission, it also reduces reliability Asai et al described tests using ethanol. Bubbles can be generated in ethanol at a temperature 70° C. less than the temperature for generating bubbles in water. Asai et al used strobe techniques to observe the time between when a bubble was generated to when the bubble disappeared. Results of these observations are schematically shown in FIG. 2. Times listed indicate time elapsed after the initiation of a 10 μS heat pulse. As can be seen, generation of the bubble begins 4 μS after start of the thermal pulse. The bubble is at its maximum size at about 8 μS after start of the thermal pulse. Afterward the bubble begins to contract. Secondary bubbles are generated after the first main bubble until the last secondary bubble completely vanishes at about 20 μS after start of the heat pulse.

Asai et al describes using a heater similar to the above-described naked heater, but with a two-layer protective structure covering the alloy thin film resistor, in order to generate bubbles in water, which has nearly the same qualities as water based ink (page 247 of Collection of Presentations from the 23rd Japan Thermal Transmission Symposium 1986-5). The results of the test are shown in FIG. 3. Power was applied so that the generation of a bubble begins at the declining edge of the thermal pulse (that is, when application of power is stopped). With this type of heater covered with the two-layer protective layer, 7 μS was required from when generation of the bubble began to when the bubble reached its maximum size. This time is fixed and independent of the duration of the thermal pulse. No data was provided for time required for the bubble to disappear. However, because generation of secondary bubbles, which is a phenomenon similar to the bubble rebound phenomenon observed during cavitation, can also be observed when the pulse width of the thermal pulse is 10 μS long, it can be assumed that bubbles begin to disappear about 25 to 30 μS after start of bubble generation.

Asai et al discloses results of generating a bubble in actual water based ink using a heater covered with the two-layered protective structure (page 253 of the Collection of Presentations from the 25th Japan Thermal Transmission Symposium 1988-6). Microscopic bubbles appeared at a portion of the heater surface at approximately 3 μS after the start of the heat pulse. Afterward, a bubble was generated over the entire surface of the heater. Asai et al did not measure the temperature at the surface of the heater nor the heat flux to the liquid in tests of the third condition.

In contrast to this, Iida et al performed tests to accurately measure these values (see page 334 of Collection of Presentations from the 27th Japan Thermal Transmission Symposium 1990-5). Iida et al heated water using a heat pulse with duration of 5 μS or more. Initial boiling nucleation in water was observed using a strobe light with an extremely short pulse of 10 nanoseconds. The shortest boiling start time was about 3.7 μS. Theoretically predicted parameters of the average speed of temperature increase and the average speed of heat flux match with the conditions observed before and after the start of boiling. Two experiments and the results of the experiments are discussed below.

(1) In one experiment, heat was applied to 20° C. water at an average speed of temperature increase of $0.56\times10^{8}$° C./sec or greater and with an average heat flux of $1.5\times10^{8}$ W/m$^2$ or greater. The temperature at the surface of the heater at the start of boiling matched the theoretical temperature (312.5° C.) at with homogeneous nucleation is believed to occur in water at atmospheric pressure. It was determined that boiling caused by this type of rapid heating is independent of the degree of liquid subcool (that is, the difference between the bulk temperature and the temperature at the surface of the heater when boiling starts).

(2) In another experiment, heat was applied at an average speed of temperature increase of $0.70\times10^{8}$° C./sec or greater and with an average heat flux of $2.1\times10^{8}$ W/m$^2$ or greater, whereupon boiling caused by swing nucleation was observed for the first time in water. It should be noted that boiling did not occur by swing nucleation when the average speed of temperature increase or the average heat flux was less than these values. The characteristics of swing nucleation as observed in the above experiment are that first a multiplicity of small bubbles with a uniform size are generated across the entire surface of the heater at a uniform distribution. The number of bubbles rapidly increases. The bubbles couple to form a bubble film at the surface of the heater.

Contrarily, in normal homogeneous nucleation, small bubbles are generated erratically on the surface of the heater. The bubbles enlarge and couple to form the bubble film. The time period from nucleation to formation of the bubble film is much slower in normal homogeneous nucleation than in swing nucleation, which requires only 1 μS or less. Although the time period from nucleation to formation of the bubble film has not been measured in spontaneous nucleation (nonhomogeneous nucleation), considering that the speed of temperature rise and the heat flux are comparatively small values, the speed of formation is probably fairly slow.

In summary, the speed from the start of boiling to formation of a bubble film is slowest in spontaneous nucleation, faster in homogeneous nucleation, and fastest in swing nucleation. The shortest observed example of time from heat pulse to boiling is about 3 μS. This can be estimated as the limit for conventional thermal resistors which require a thick two-layer protective covering.

The fourth condition for allowing stable ejection of ink at a high repetition speed relates to the contraction and disappearance of bubbles. There have been many attempts to control the speed at which bubbles contract and disappear in order to smooth recuperation of the meniscus after ejection and moreover to shorten the frequency and increase the speed of ejections. For example, Japanese Patent Application Kokai No. SHO-55-132267 describes setting the duration of time required for the surface of the heater to cool to longer than the time required to heat the surface of the heater. Japanese Patent Application Kokai Nos. SHO-55-161662, SHO-55-161663, and SHO-56-13177 describe setting the time required for the temperature at the surface of the heater to cool by half to a duration of time longer than the time required to heat the surface but shorter than four times the time required to heat the surface. However these publications do not accurately disclose data or the technical basis for these determinations. Additionally, the technical content and results of controlling the speed of bubble contraction and disappearance is questionable.

Publications by Asai and others refute these inventions (Collection of Presentations from the 22nd Japan Thermal Transmission Symposium 1985-5 and in Collection of Presentations from the 23rd Japan Thermal Transmission Symposium 1986-5). A film shaped bubble generated on the heater by application of a pulse of heat expands explosively at high pressure (several tens to hundreds of atmospheres) and at high temperature (about 300° C.). Expanding gas in the bubble is cooled by the surrounding room temperature liquid, i.e., the ink. When the bubble is at its maximum size, the interior of the bubble is almost a complete vacuum. In the next instant, the bubble begins to contract, and vanishes in about 5 μS. The heat flux from the surface of the heater to the bubble is negligible when the heater is covered by the bubble. Therefore, the speed of contraction is virtually constant and independent of the temperature at the surface of the heater.

However, when the temperature at the surface of the heater does not decrease even after the initial bubble disappears, secondary bubbles are repeatedly generated. Generation of secondary bubbles interferes with recuperation of the meniscus after ink is ejected. Inducing boiling by heating at portion of a liquid that is cooler than boiling temperature is termed subcool boiling. Thermal ink jet print heads use subcool boiling when the amount of subcooling is large. As can be seen in FIG. 3, the time required for a bubble to contract and disappear is twice as long as the time required to generate the bubble. Before a bubble is generated, a pulse of heat with long duration (10 to 50 μS) is applied to heat the water on the heater, to increase the volume of water that boils as a result, and to increase the volume of the bubble. The time for contraction of the resultant large volume bubble is about 10 μS. Whether the secondary generation of bubbles shown in FIG. 3 results from insufficient cooling of the heater temperature or from cavitation by the contraction of the bubble volume is unknown, but secondary generation of bubbles occurs in all bubble contractions in conventional technology.

In Japanese Patent Application Kokai Nos. SHO-55-27281 and SHO-55-27282, Asai et al teaches that the rise in temperature of the heater and the subsequent cooling speed should be as rapid as possible. The only fixed quantity mentioned however is an extremely long pulse of 100 μS.

In order to increase the frequency or ejections and provide stable ejection at the same time, boiling must be started as quickly as possible after application of the energy pulse to the thermal resistor and also the expanded bubble must be caused to disappear as rapidly as possible. Conventional technology requires that thin film resistors include a two-layer protective coating. Such thin film resistors require at least 3 μS from after start of application of the energy pulse to when the film boiling begins. Even naked thin film thermal resistors with no protective layers, which are unreliable and impractical, require at least 4 μS to generate bubbles in ethanol. Bubbles require 30 μS or more to disappear from start of the pulse application with thin film thermal resistors with two-layer protection coverings. Bubbles generated by naked thermal resistors in ethanol require 20 μS or more to disappear. Secondary bubbles are also always generated. Secondary generation of bubbles increases the time required for bubbles to disappear, thereby interfering with efforts to increase the frequency of ejections. A large amount of energy, that is, about 17 μJ/50×50 μm$^2$ or more, is required to start boiling with film thermal resistors with two-layer protective coverings. Although details will be explained later in the embodiment of this application, only several μJ/50×50 μm$^2$ or less of energy are required to start boiling by a protection-layerless thin film thermal resistor. Therefore, almost all of the energy applied to conventional heaters is used to heat the substrate. For this reason, the surface of the heater is hot while the bubble is vanishing. This is a major source of secondary bubble generation. Heating of the substrate is brought about by the material from which the ink channel is produced and the temperature of the ink. This is a source of unstable ink ejection.

SUMMARY OF THE INVENTION

It is an objective of the present invention to provide stable ink ejection and an increased frequency by reducing the necessary boiling start time, increasing the speed at which nucleated bubbles grow into a bubble film, preventing generation of secondary bubbles, and reducing the bubble disappearance time. The present invention also allows great reductions in the energy required to start boiling and allows production of an ink ejection recorder with high reliability, high speed, and high thermal efficiency.

An ink ejection recording device according to the present invention includes an ink channel filled with ink and a nozzle which brings the ink channel into fluid connection with the outside atmosphere. A thermal resistor is formed in the ink channel near the nozzle. The thermal resistor has no protective layers as described in Japanese Patent Application Kokai Nos. HEI-04-347150 and HEI-05-68257. The thermal resistor can be driven with an extremely short pulse of voltage because it has no protective layers. Despite having no protective layers, the thermal resistor is highly reliable. By applying a pulse of voltage that is 3 μS or shorter to the thermal resistor, the ink in contact with the thermal resistor begins to boil in less than 2 μS after start of application of the voltage pulse to the thermal resistor. The ink in contact with the thermal resistor is rapidly vaporized by subcool boiling, which is caused by swing nucleation. An expanding bubble is formed as a result. The expansion of the bubble ejects a droplet of ink from the nozzle. The bubble disappears within 11 μS after start of application of the voltage pulse without generation of secondary bubbles. Only 4 $\mu J/50\times50\ \mu m^2$ worth of energy is required to generate a bubble.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
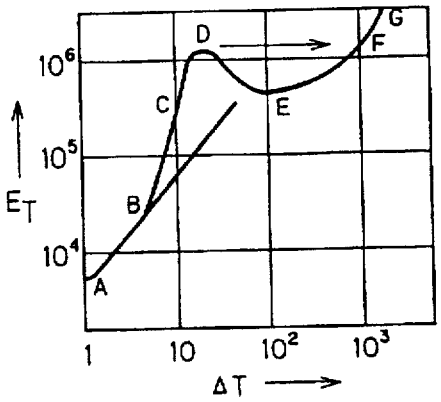
FIG. 1 is a graphical representation of the boiling characteristic curve of water.

An ink jet printer according to a preferred embodiment of the present invention will be described while referring to the accompanying drawings wherein like parts and components are designated by the same reference numerals to avoid duplicating description.

Figure 4:
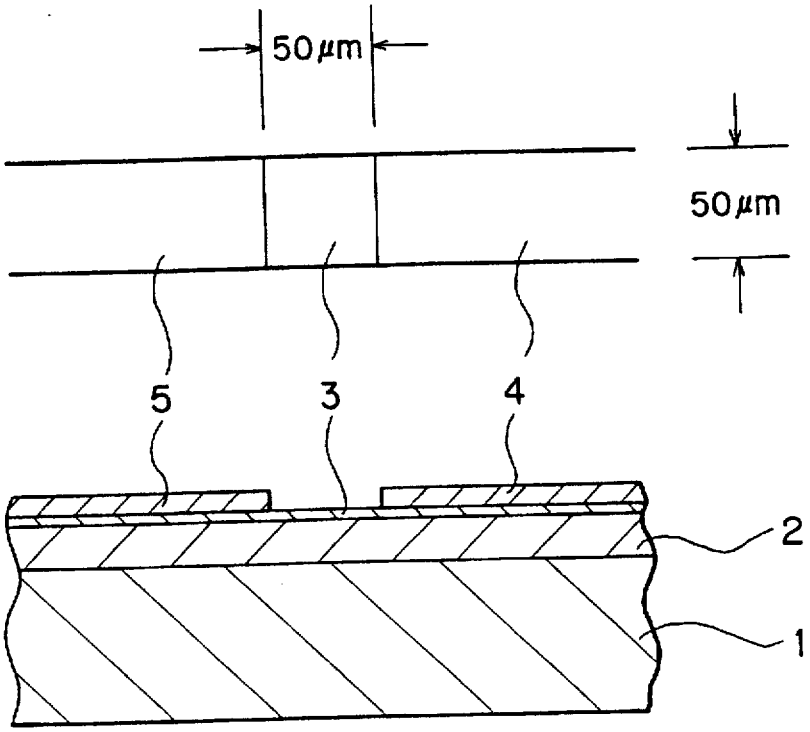
FIG. 4 shows top and cross-sectional views of a thin film thermal resistor according to the present invention.

FIG. 4 shows planar and cross-sectional views of a highly reliable protection-layerless thin film thermal resistor as described in co-pending U.S. application Ser. No. 08/172,825 filed Dec. 27, 1993. In this protection-layerless thin film thermal resistor, an $SiO_2$ layer of 2 μm thickness is formed on an Si substrate of 400 μm thickness, and a thin film thermal resistor 3 of 0.1 μm thickness is formed on the $SiO_2$ layer 2. Conductors 4 and 5 each being 0.1 μm in thickness are formed on the thin film thermal resistor 3. In this example, the thin film thermal resistor 3 is made from a Cr—Si—SiO alloy thin film resistor and the conductors 4 and 5 are made from nickel (Ni). However, the film thermal resistor 3 could be made from Ta—Si—SiO alloy in lieu of Cr—Si—SiO alloy, and the conductor material could be tungsten (W) or tantalum (Ta). Refer to Japanese Patent Application Kokai No. SHO-58-84401 in regards to the use of Cr—Si—SiO alloy thin film resistor, and refer to Japanese Patent Application Kokai No. SHO-57-61582 in regards to the use of Ta—Si—SiO alloy thin film resistor. The resistance of the resistor 2 is about 1 KΩ.

In one experiment for the present application, bubbles were generated by applying a pulse of voltage to the protection-layerless thin film thermal resistor in water. Images of the generation and disappearance of the bubbles were taken using a strobe light with a pulse time of about 1 μS. Results observed from these images will be explained below.

In another experiment for the present application, an ink channel was formed on the protection-layerless thin film thermal resistor. The ink channel was filled with ink. It will be explained later that the same results as obtained with water were obtained with ink.

For still another experiment, a multi-nozzle type ink jet printer head was formed from with a plurality of the ink channels described in the preceding paragraph. Ink droplets were continuously ejected from the head. An explanation will be provided of the recording characteristics of the head.

Figure 5:
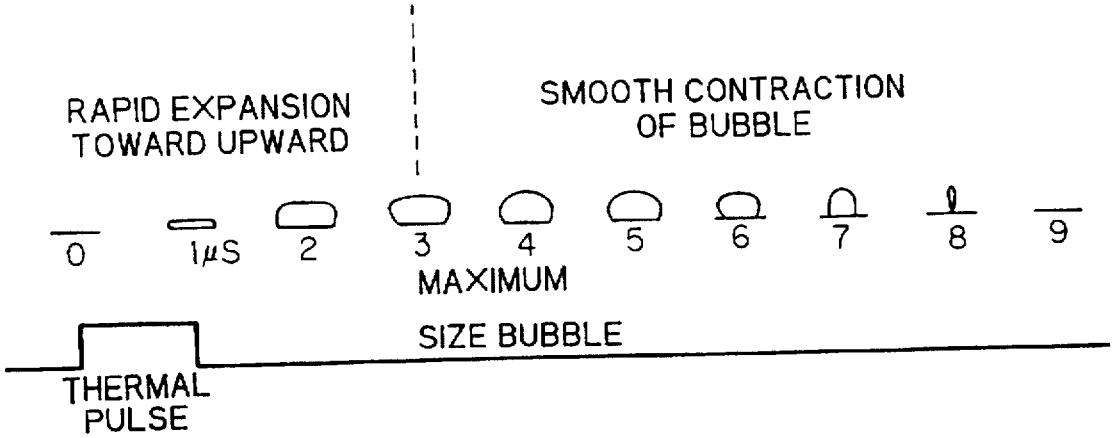
FIG. 5 schematically shows temporal changes from generation to disappearance of a bubble generated in water by pulse heating by the thermal resistor shown in FIG. 4.

Bubbles are generated in water applied to the surface of the substrate 1 by application of a 1 μS thermal pulse having an applied energy of 2.5 μJ per pulse. Image were taken from the side with a VTR at about a 100 power magnification rate using a strobe light with shortest possible light pulse time of 1 μS. An example of the results are shown in FIG. 5. The time indicate the number of μS after start of the thermal pulse. Images taken when the applied energy was increased two to three times higher all appeared the same as shown in FIG. 5. Although generation of the bubble might actually have started earlier because of increased applied energy, the difference is difficult to discern with a magnification rate and pulse time used. Although no increase in the start of bubble generation could be measured under these conditions, it is clear that boiling began within 1 μS from the start of the thermal pulse.

As can be seen in FIG. 5, the generated bubble reached its maximum volume (negative pressure) and height (about 30 μm) within about 3 μS after start of the thermal pulse. About 5 μS later, the bubble vanishes with no generation of secondary bubbles. That is, by the time the bubble vanished, the surface of the thermal resistor had cooled to near room temperature. Energy produced when a bubble of this volume vanishes is insufficient to cause cavitation. Excessive heating of the ink is avoided and heat efficiency is improved. The temperature of the ink is stabilized, which in turns stabilizes the viscosity of the ink, thereby improving stability of ink ejection conditions. Coagulation of ink to the heater surface is prevented.

The average speed of the temperature increase produced by the thin film thermal resistor according to the present invention is, for example, $3\times10^{8}$° C./sec (350° C.–25° C./1 μS, assuming room temperature is 25° C.). This exceeds the above-described maximum value of $0.7\times10^{8}$° C./sec for average speed of temperature increase attainable using conventional technology. Although the power applied to the heater is large, i.e., $1\times10^{9}$ W/cm$^2$, considering that 70 to 80% of this goes to the substrate as heat flux, this matches the conditions for swing nucleation observed by Iida et al (page 335 of the Collection of Presentations from the 27th Japan Thermal Transmission Symposium 1990-5). Furthermore, a bubble film about 5 to 10 μm high is formed on the surface of the thermal resistor about 1 μS after pulse heating is started. The speed at which the bubble grows is faster than the growth speed under the conditions for swing nucleation observed by Iida et al. That i, from these results, the bubble shown in FIG. 5 is generated by swing nucleation induced boiling.

The average speed at which the bubbles expanded (i.e., (dv/dt)/v) can be determined from FIG. 5 as $4\times10^{5}$/S, a much faster average speed than disclosed in Japanese Patent Application Kokai No. SHO-55-161665. This value remained constant, even when the duration of the applied pulse was increased to 2 or even 4 μS, which is also different from the data disclosed in Japanese Patent Application Kokai No. SHO-55-161665. The difference in speeds of bubble expansion probably appears because swing nucleation produces a much faster average speed of temperature increase than does spontaneous nucleation.

All factors must be taken into account when setting the duration of the thermal pulse. For example, heat efficiency is greatly improved when the thermal pulse is shorter than 1 μS. However, the time at which swing nucleation starts increases to at best only 0.5 μS after start of the heat pulse. These benefits are small considering the time from application of the pulse to when the bubble disappears (about 8 μS in FIG. 20 and the time required for the meniscus to recover after ink is ejected (several 10s or 100s μS). Additionally, the power (applied voltage) must be increased to compensate for the short duration of the thermal pulse, which can be disadvantageous. A thermal pulse with duration of more than 1 μS risks generation of secondary bubbles and a drop in heat efficiency. The maximum duration of the thermal pulse is probably 3 μS. This would translated into boiling start time of 2 μS after start of the pulse.

As can be seen in FIG. 5, no secondary bubbles are generated in bubble generation according to the present invention. Therefore, the time required for a bubble to totally disappear is shortened. Ink ejection is stabilized and the ejection cycle can be reduced so that high speed ejection is possible.

Figure 3:
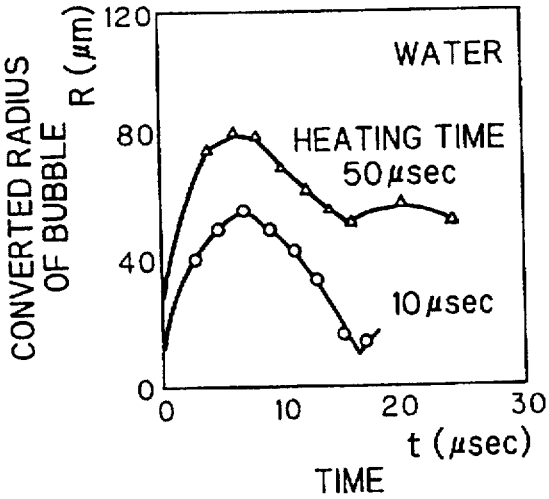
FIG. 3 shows a graphical representation of temporal changes in radius of the bubbles generated using a conventional thermal resistor.
Figure 2:
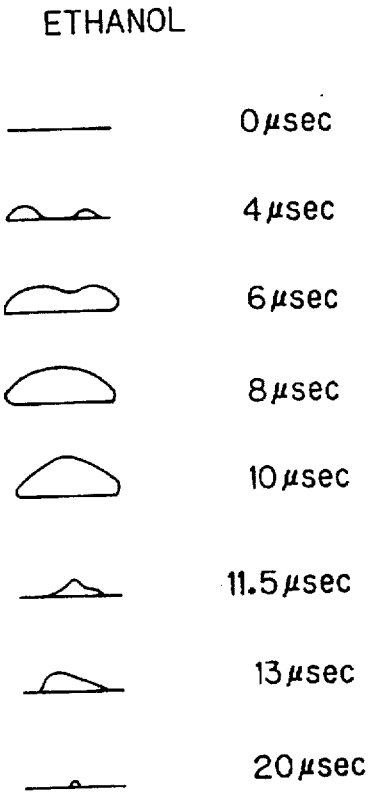
FIG. 2 schematically shows temporal changes from generation to disappearance of a bubble generated in ethanol using a conventional thermal resistor.

In the conventional bubble generation shown in FIG. 2, wherein a bubble was generated in ethanol, 12 μS elapsed between when the bubble was at its maximum volume (that is, at the 8 μS point) to when the bubble disappeared entirely. In water, as shown in FIG. 3, 20 μS or more was necessary. Generation of secondary bubbles clearly causes the need for such long disappearance times (that is, time required for a bubble to go from its maximum size to complete disappearance). Asai et al (1986) explains this long disappearance time as being caused by bubble rebound phenomenon, which is very similar to cavitation damage.

The present invention confirmed generation of secondary bubbles using a heater from a Hewlett Packard ink jet printer (Model No. JP51626A). The disappearance time was about 10 μS. However, the present inventors have determined that this generation of secondary bubbles is not cavitation-like rebound as Asai et al stresses, but is caused simply by the heater temperature not cooling sufficiently during the disappearance time. If secondary bubbles are generated by a hot heater surface, removing this cause should prevent generation of secondary bubbles and reduce disappearance time.

Figure 6:
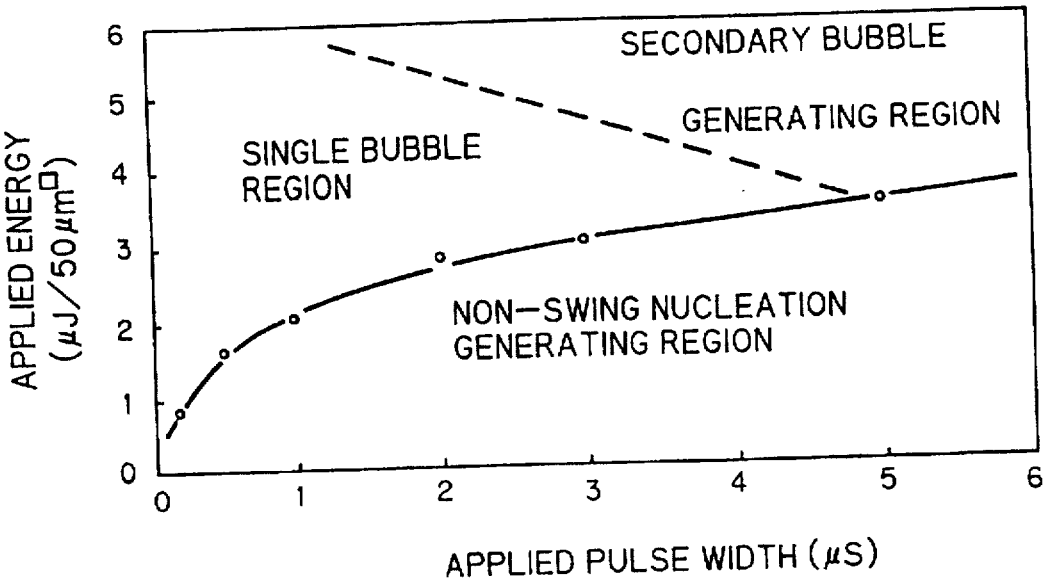
FIG. 6 is a graphical representation showing a relationship between energy level and pulse duration applied to the thermal resistor shown in FIG. 4 to induction of swing nucleation (solid line) and single bubble generation region (dash line)

The present inventors performed tests to confirm this. A protection-layerless thin film thermal resistor shown in FIG. 4 was produced. The thin film thermal resistor was energized in water at various energy levels and for various durations of time. The generation and disappearance of the resultant bubbles were observed using a strobe light. The results of the test are shown in FIG. 6. The solid line indicates the limit of the range at which swing formation occurred. The broken line indicates the limit of the range at which generation of secondary bubbles are observed. The region labeled "single bubble region" in FIG. 6 is where a single bubble could be stably and repeatedly generated. The disappearance time was constantly about 5 μS throughout the single bubble region. Stable repetitive generation of bubbles without generating secondary bubbles was possible in a sufficiently broad range of drive conditions.

It is clear that secondary bubbles are generated because the heater does not cool quickly enough and remains hot enough to generate bubbles. Therefore the disappearance time required for a bubble to disappear without generation of secondary bubbles depends on the characteristics of the liquid in which the bubble is generated, not on the drive conditions of the thermal resistor. In water, the disappearance time was constant at about 5 μS. These results were basically repeated in tests using water based ink.

In the present invention, the ripple effect greatly shortens the time required for heating and greatly decreases the amount of ink that burns onto the surface of the heater. This increases the life of the head to the point where head replacement is unnecessary.

In the present invention, the duration of the thermal pulse is set to 3 μS or less so that the generation of secondary bubbles is effectively prevented. Additionally, the disappearance time is about 8 μS, which is a great improvement over conventional technology. Swing nucleation allows a bubble to disappear in 10 to 11 μS or less after start of the voltage pulse, which is approximately ½ to ⅓ the time required with conventional technology. As is clearly shown in FIG. 6, the energy required to stably generate single bubbles is 4 μJ/50×50 μm$^2$ or less, which is ⅕ to ⅒ the amount of energy required for conventional technology.

A single nozzle head was produced to observe the above described effects. To produce the observation head, a channel with width of 60 μm and height of 40 μm was provided to the substrate 1 shown in FIG. 4. The single nozzle with a diameter of about 45 μm was provided perpendicular to the channel and to the surface of the thermal resistor at a position centered on the thermal resistor. Images were taken of generation and disappearance of bubbles from a thin side wall using a strobe light. Results were as predicted. The shape of the bubble was somewhat different because the channel formed boundaries for the liquid. However, this channel will not greatly effect generation and disappearance of bubbles.

Tests and results of the tests regarding generation and disappearance of bubbles when a protection-layerless thin film thermal resistor is pulse heated are described in detail above. The time required to generate a bubble and time required for the bubble to disappear are greatly reduced. This contributes greatly to increasing the repetition frequency of stable ejection of ink. The amount of energy needed to eject ink is reduced by an order of magnitude as mentioned above. This shows that almost no energy is consumed in heating the channel material or ink. The temperature of ink in the head need not be maintained at any particular level. Also, because the amount of ink that burns and becomes stuck to the surface of the heater is greatly reduced, the life and reliability of the head are greatly increased.

To summarize, it is desirable that the total amount of electric power applied to the thermal resistor, the thermal flux applied to ink, and the speed of temperature increase in ink (STI) be set as indicated in the table below in relation to the duration of a pulse of voltage (DPV) applied to the thermal resistor which is set to 3 μs, 2 μs and 1 μs.

| DPV (μs) | Total Power ($W/m^2$) | Thermal Flux ($W/m^2$) | STI (°C./s) |
|---|---|---|---|
| 3 | $4 \times 10^8$ | $1 \times 10^8$ | $1.1 \times 10^8$ |
| 2 | $5.6 \times 10^8$ | $1.4 \times 10^8$ | $1.6 \times 10^8$ |
| 1 | $8 \times 10^8$ | $2 \times 10^8$ | $3 \times 10^8$ |

The total electric power applied to the heater can be computed by dividing the applied energy with by the duration of pulse voltage. The heat flux applied to ink is computed on the assumption that the heat flux applied to the ink is one quarter (¼) of the total amount of power applied to the heater based on the previous disclosure that 70 to 80% of power applied to the heater goes to the substrate as heat flux. The speed of temperature increase in ink is obtained as per a unit of time, second.

From the above table, various parameters to produce bubbles by subcool boiling caused by swing nucleation are set as follows according to the present invention. The pulse of voltage applied to the heater has a duration equal to or less than 3 μsecond. Speed of temperature increase in the ink is set equal to or greater than $1.1 \times 10^{8}$° C./sec, and heat flux applied to the ink by the heater is set equal to or greater than $1 \times 10^8$ $W/m^2$.

Figure 7:
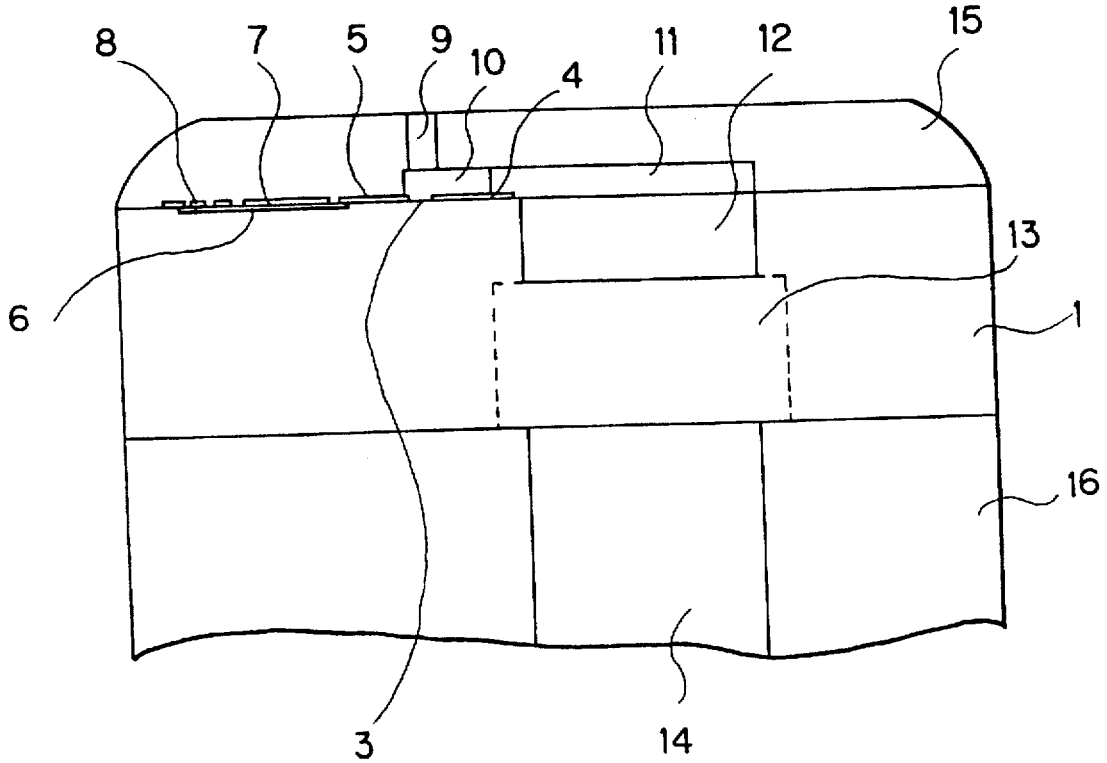
FIG. 7 is a cross-sectional view showing a print head according to the present invention.

Next, the multi-nozzle type ink jet printer head shown in FIG. 7 was produced using the thin film thermal resistor shown in FIG. 4. First, a Cr—Si—SiO— alloy thin film thermal resistor 3 and an integrated circuit (IC) 6 for driving the thermal resistor 3 were formed on the surface of a silicon substrate 1. For driving the head, a nickel common wire conductor 4, individual nickel wire conductors 5, drive power wire conductors 7, and signal wire conductors 8 were formed to the substrate 1. An ink channel plate 15 was formed with ink nozzles 9, individual ink channels 10, and a common ink channel 11. The ink channel plate 15 was mounted to the silicon substrate 1 to form a monolithic large scale integrated (LSI) head. The monolithic LSI head was die bonded to a frame 16. Ink was supplied to the ink channels 11 from the ink channel 14 in the frame 16 and through connection aperture 13 and the common ink channel 12 in the silicon substrate 1. Ink was ejected from one ink nozzle 9 after another. In this example, the Cr—Si—SiO alloy thin film thermal resistor 3 was formed to 45 μm by 45 μm, the ink channel nozzle was formed to a diameter of 45 μm, and the individual ink channels were formed with a width of about 50 μm, a height of 35 μm, and a length of 150 μm.

A plurality of ink nozzles 9 were provided aligned at a pitch of about 7 μm (360 dpi) in the direction perpendicular to the surface of the sheet one which FIG. 7 is drawn. Heads of various sizes can be produced as described in Japanese Patent Application Kokai No. HEI-05-90123. For example, a small serial scanning type head with total number of, for example, 64 nozzles can be produced or a line head for A4 size paper or larger with two rows of 1,512 nozzles, for a total of 3,024 nozzles, can be produced.

Tests were performed to determine the recording characteristics of the head. The maximum frequency at which ejection could be stably performed was determined to be 8 KHz. As a comparison, a head produced by Hewlett-Packard with the same configuration as shown in FIG. 7, but wherein the thin film thermal resistors are covered with a two-layer protective covering, has a maximum frequency of about 6 kHz. The head according to the present invention required between 2.0 to 2.5 μJ/droplet for ejection, which can be over an order of magnitude less than the 17 to 30 μJ/droplet required for ejection by conventional heads. The head according to the present invention showed stable ejection even after 100 million or more ejections. The same results were obtained in a print head according to the present invention wherein the direction of ejection is parallel with the surface of the heater.

According to the present invention, by driving a protection-layerless heater with only a short pulse of voltage, ink can be heated at an extremely fast average speed of temperature increase. Therefore, the time between when the pulse is applied to when the bubble disappears is 11 μS or less. This is about ⅓ the time for conventional technology. The print speed (ejection frequency) of the thermal ink jet print head according to the present invention is 30% or greater than conventional heads. About one order of magnitude less power is consumed.

While the invention has been described in detail with reference to a specific embodiment thereof, it would be apparent to those skilled in the art that various changes and modifications may be made therein without departing from the spirit of the invention, the scope of which is defined by the attached claims.

What is claimed is:

1. An ink ejection recording device comprising:

an ink channel filled with a water-based ink;

a nozzle for fluid-connecting said ink channel with an outside atmosphere;

a thermal resistor formed in said ink channel adjacent the nozzle, said thermal resistor comprising a protection-layer-less thermal resistor; and means for applying a pulse of voltage connected to said thermal resistor, said means for applying a pulse of voltage controlling a heat flux applied to the ink by said thermal resistor to no less than $1 \times 10^8$ $W/m^2$, said pulse causing said thermal resistor to heat so that a portion of the ink in said ink channel is vaporized by subcool boiling, which is caused by swing nucleation, to produce a bubble and so as not to form secondary bubbles, expansion of the bubble ejecting an ink droplet from said nozzle.

2. An ink ejection recording device as claimed in claim 1, wherein the pulse of voltage is controlled by said means for applying a pulse of voltage so that said pulse of voltage is applied to the thermal resistor for no more than 3 μS.

3. An ink ejection recording device as claimed in claim 1, wherein said means for applying a pulse of voltage applies a second pulse of voltage to the thermal resistor no later than 11 μS after application of the pulse of voltage begins.

4. An ink ejection recording device as claimed in claim 1, wherein said thermal resistor comprises Cr—Si—SiO alloy.

5. An ink ejection recording device as claimed in claim 1, wherein said thermal resistor comprises Ta—Si—SiO alloy.

6. A device as in claim 1, wherein said pulse of voltage has a power of at least $4\times10^8$ W/m$^2$ and is applied for no more than 3 μS.

7. A device as in claim 1, wherein said pulse has a power of at least $5.6\times10^8$ W/m$^2$ and is applied for no more than 2 μS.

8. A device as in claim 1, wherein said pulse has a power of at least $8\times10^8$ W/m$^2$ and is applied for no more than 1 μS.

9. A device as in claim 1, wherein said swing nucleation begins less than 1 μS after said pulse of voltage begins.

10. A device as in claim 1, wherein said bubble fully condenses no more than 8 μS after said pulse of voltage ends.

11. A device as in claim 1, wherein said thermal resistor and said means for applying a pulse of voltage require no more than 2.5 μJ to eject said ink droplet from said nozzle.

12. An ink ejection recording device comprising:

an ink channel filled with a water-based ink;

a nozzle for fluid-connecting said ink channel into fluid connection with an outside atmosphere;

a thermal resistor formed in said ink channel adjacent the nozzle, said thermal resistor comprising a protection-layer-less thermal resistor; and means for applying a pulse of voltage connected to said thermal resistor to cause said thermal resistor to vaporize a portion of the ink in said ink channel and to produce a growing bubble, the growing bubble causing an ink droplet to eject from said nozzle, wherein the means for applying a pulse of voltage limits said pulse of voltage applied to said thermal resistor to a duration of no more than 3 μsecond, said means for applying a pulse of voltage controlling a speed of temperature increase in the ink to no less than $1.1\times10^{8}$° C./sec, and said means for applying a pulse of voltage controlling a heat flux applied to the ink by said thermal resistor to no less than $1\times10^8$ W/m$^2$, so that the growing bubble is produced by subcool boiling caused by swing nucleation.

13. A device as claim 12, wherein said pulse of voltage has a power of at least $4\times10^8$ W/m$^2$.

14. A device as in claim 12, wherein said pulse of voltage has a power of at least $5.6\times10^8$ W/m$^2$ and is applied for no more than 2 μS.

15. A device as in claim 12, wherein said pulse of voltage has a power of at least $8\times10^8$ W/m$^2$ and is applied for no more than 1 μS.

16. A device as in claim 12, wherein said swing nucleation begins less than 1 μS after said pulse of voltage begins.

17. A device as in claim 12, wherein said growing bubble fully condenses no more than 8 μS after said pulse of voltage ends.

18. A device as in claim 12, wherein said thermal resistor and said means for applying a pulse of voltage require no more than 2.5 μJ to eject said ink droplet from said nozzle.

* * * * *